US006533628B1

(12) United States Patent
Matsutani

(10) Patent No.: US 6,533,628 B1
(45) Date of Patent: Mar. 18, 2003

(54) METHOD OF MANUFACTURING SPARK PLUG AND SPARK PLUG

(75) Inventor: Wataru Matsutani, Nagaya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 09/546,206

(22) Filed: Apr. 10, 2000

(30) Foreign Application Priority Data

Apr. 30, 1999 (JP) ..... 11-124131
May 20, 1999 (JP) ..... 11-140751

(51) Int. Cl.[7] ..... H01T 21/02
(52) U.S. Cl. ..... 445/7; 219/121.64; 313/141
(58) Field of Search ..... 445/7; 219/121.64; 313/141

(56) References Cited

U.S. PATENT DOCUMENTS 5,320,569 A 6/1994 Oshima et al. ..... 445/7
5,461,275 A * 10/1995 Oshima ..... 313/141
5,607,605 A * 3/1997 Musasa et al. ..... 219/121.64
5,793,151 A * 8/1998 Kagawa et al. ..... 313/141

FOREIGN PATENT DOCUMENTS

EP 0 575 163 A1 12/1993 ..... H01T/13/39
EP 0 583 103 A1 2/1994 ..... H01T/21/02
JP 6045050 2/1994 ..... H01T/21/02
JP 06-188062 7/1994
JP 07-037674 2/1995
JP 08-050983 2/1996
JP 09-106880 4/1997
JP 10-112374 4/1998 ..... H01T/21/02
JP 11-233233 8/1999

OTHER PUBLICATIONS

Japanese Abstract No. 10112374, dated Apr. 28, 1998.
Japanese Abstract No. 06045050, dated Feb. 18, 1994.
Japanese Abstract No. 07296943, dated Nov. 10, 1995.

* cited by examiner

*Primary Examiner*—Kenneth J. Ramsey
(74) *Attorney, Agent, or Firm*—Sughrue Mion, PLLC

(57) ABSTRACT

A noble metal chip 31' is superimposed on a surface of a central electrode 3 made of a heat resisting alloy, the main component of which is Ni or Fe, to which the chip is secured so that a superimposed assembly 70 is constituted. A perimeter laser weld portion 10 across the noble metal chip 31' and a chip securing surface forming portion is formed around the outer surface of the chip of the superimposed assembly 70. Thus, the noble metal chip 31' is secured to the chip securing surface so that a noble-metal igniting portion 31 is constituted. To form the perimeter laser weld portion 10 which has a maximum outer dimension dmax which is smaller than 2.0 mm and which does not reach the discharging surface 31*a* in a direction of the thickness of the noble metal chip 31', a laser beam source 50 is, as a light source of laser beams for use in a welding operation, employed-which is arranged such that energy per pulse is 2 J to 6 J, the length of the pulse is 1 millisecond to 10 milliseconds and the pulse generating frequency is 2 pulse/second to 20 pulse/second.

10 Claims, 9 Drawing Sheets

METHOD OF MANUFACTURING SPARK PLUG AND SPARK PLUG

FIELD OF THE INVENTION

The present invention relates to a method of manufacturing a spark plug and the spark plug.

DESCRIPTION OF THE RELATED ART

As spark plugs serving as igniting means for internal combustion engines, spark plugs of a type having a noble-metal igniting portion have been used in recent years to improve resistance against sparks, the spark plugs being formed at the leading end of an electrode by welding a noble metal chip, the main component of which is Pt or Ir. When a noble metal chip is joined to the leading end surface of, for example, a central electrode, a method has been disclosed for example, in JP-A-6-45050 (U.S. Pat. No. 5,320,569, EP-0 583 103 B1) and JP-A-10-112374. The method has the steps of superimposing a disc-shaped metal chip on the leading end of the central electrode and irradiating the outer surface of the superimposed surfaces with a laser beam while the central electrode is being rotated so that a perimeter laser weld portion is formed.

In recent years, the temperature in the combustion chamber has been raised because the performance of the internal combustion engine has been improved. Moreover, engines of a type having a structure that the diameter of the igniting portion of the spark plug is reduced to be 2.0 mm or smaller so that the igniting portion is allowed to project into the combustion chamber in order to improve ignition easiness have been widely employed. To improve resistance of the noble metal chip against separation in the severe atmosphere for use, a method has been employed with which a noble metal chip, the main component of which is Ir or Pt, is welded to an electrode made of a heat resisting alloy composed of Ni groups or Fe groups so as to form a noble-metal igniting portion.

The noble metal chip is usually welded to the spark plug by using pulse laser beams, such as YAG laser beams. The conditions under which the laser beam is applied have been determined such that the pulse generating frequency is a relatively low value of 0.5 pulse/second or lower. The foregoing method, however, requires an excessively long time of about 15 seconds to weld a noble metal chip having a diameter of about 0.7 mm. Therefore, there arises a problem of unsatisfactory productivity for each laser welding apparatus.

Problems to be Solved by the Invention

To solve the problem of deterioration in the productivity, it is effective to raise the pulse generating frequency of the laser beams. As a result of investigations performed by the inventor of the present invention, the following problem has been found. When the pulse generating frequency of the laser beam is simply raised to improve the productivity, the heat resisting alloy composed of Ni groups or Fe groups for use as the material of the electrode and having a low heat conductivity suffers from an unsatisfactory fall in the temperature. When the leading end of the electrode has a small diameter, the fall in the temperature of the electrode is sometimes delayed as compared with application of heat which is performed for each pulse of the laser beam. As a result, the rear portions of a weld portion 10 in the circumferential direction are heated excessively, as shown in FIGS. 13A and 13B. Therefore, there arises a problem in that the weld portion is made to be nonuniform such that a rear weld portion 10*s* is deeply welded as compared with a front weld portion 10*p*. As an alternative to this, the width I of the weld portion is enlarged excessively. Since the weld portion 10 is constituted by an alloy of a material of a noble metal chip and a material of the electrode, the resistance against sparks of the weld portion 10 is inferior to that of only the noble metal chip. If the depth or the width of the weld portion 10 is enlarged excessively, the durability of an igniting portion 31 formed by welding the noble metal chip excessively deteriorates. In a region in which the width I of the weld portion 10 has been enlarged, the weld portion 10 is exposed to a discharging surface 31*a* in extreme cases. If the exposure is prevented, exposure of the weld portion 10 occurs in a case where the igniting portion 31 is somewhat consumed. In general, a spark plug is provided with the noble-metal igniting portion for the purpose of elongating the lifetime of the igniting portion (for example, lifetime corresponding to driving for 100,000 km to 160,000 km). If the foregoing problem arises, consumption of the exposed portion proceed. As a result, there sometimes arises a problem of misfire or the like because the spark discharge gap is enlarged in a relatively short time.

SUMMARY OF THE INVENTION

An object of the present invention is to provide a method of manufacturing a spark plug capable of significantly improving efficiency of a process for welding a noble metal chip to an electrode and obtaining a uniform weld portion and a spark plug having durability of an igniting portion to a degree not heretofore attained.

To solve the problems, according to the present invention, there is provided a method of manufacturing a spark plug comprising a central electrode and a ground electrode disposed such that the side surface of the ground electrode is opposite to the leading end surface of the central electrode and having a structure that a noble-metal igniting portion having a discharge surface is provided for at least either of the central electrode or the ground electrode at a position corresponding to a spark discharge gap by welding a noble metal chip, the method of manufacturing a spark plug comprising the steps of:

- constituting at least a chip securing surface forming portion of the central electrode and/or the ground electrode is formed with a heat resisting alloy having Ni or Fe as a main component thereof and superimposing the noble metal chip on a chip securing surface so as to form a superimposed assembly;
- providing a perimeter laser weld portion across the noble metal chip and the chip securing surface forming portion for the outer surface of the chip constituting the superimposed assembly so that the noble metal chip is secured to the chip securing surface; and
- forming the perimeter laser weld portion having a maximum outer dimension dmax plane-viewed from the chip interposing direction is smaller than 2.0 mm and so formed not to reach the discharge surface in a direction of the thickness of the noble metal chip by using, as a light source for laser welding, a pulse laser beam source having energy per pulse of 1.5 J to 6 J, a pulse length of 1 millisecond to 10 millisecond and a pulse generation frequency is 2 pulse/second to 20 pulse/second.

The chip securing surface forming portion is constituted by the heat resisting alloy, the main component of which is Fe or Ni, and the small-diameter perimeter laser weld portion having a maximum outer dimension dmax which is smaller than 2.0 mm is formed. The inventors of the present invention has energetically performed studies. Thus, the following facts have been detected. That is, it is important that the pulse generating frequency satisfies a specific range to efficiently form a uniform weld portion. Moreover, it is important that conditions of the energy per pulse of a laser beam and the length of each pulse are made to be specific values. The following fact has been detected: in a state where the foregoing conditions are set, the problem of the nonuniform weld portion and the like can be solved if a frequency higher than the frequency employed in the conventional method is employed in only a specific pulse frequency range. Thus, the present invention has been established. That is, the laser beam having energy per pulse of 1.5 J to 6 J, a pulse length of 1 millisecond to 10 milliseconds is employed. Moreover, 2 pulse/second to 20 pulse/second which is a pulse generating frequency which is considerably higher than the pulse generating frequency employed in the conventional method is employed. Thus, a perimeter laser weld portion exhibiting excellent uniformity can significantly efficiently be formed.

In this specification, the maximum outer dimension dmax of the perimeter laser weld portion is, as shown in FIG. 2B, defined as dmax=2 rmax when the position of the geometric center of gravity of the discharging surface (31*a*) realized when the perimeter laser weld portion is projected onto a plane which is perpendicular to the central axis of the central electrode (3) is G and the distance from G to a farthermost end of the perimeter laser weld portion is rmax.

When the length of the pulse is shorter than 1 millisecond or when the energy of each pulse is smaller than 1.5 J, the quantity of heat which is input per pulse is reduced and, therefore, the weld portion cannot satisfactorily be formed. When the energy of each pulse is smaller than 1.5 J and also the length of the pulse is shorter than 1 millisecond, the quantity of heat input is reduced excessively. When the electrode is constituted by the heat resisting alloy composed of the Ni groups or the Fe groups, the influence of fall of the temperature of the electrode causes a fact that the electrode is not substantially fused. In the foregoing case, the weld portion cannot easily be formed.

When energy of each pulse is larger than 6 J or when the length of the pulse is longer than 10 milliseconds, accumulation of input heat caused from the laser beams easily occurs because the fall of the temperature of the electrode constituted by the heat resisting alloy composed of the Ni groups or the Fe groups is very small. Thus, there is apprehension that nonuniformity of the depth or the width of the weld portion occurs or the electrode is melted and deformed. When the energy of each pulse is larger than 6 J and the length of the pulse is longer than 10 milliseconds, molten metal is easily evaporated and scattered. In the foregoing case, there is apprehension that defects of the electrode, such as dents and holes, easily occur.

When the pulse generating frequency is lower than 2 pulse/second, the weld portion cannot efficiently be formed. When the pulse generating frequency is higher than 20 pulse/second, accumulation of heat inputs caused from the laser beam easily occurs. In the foregoing case, similar problems arise. It is preferable that the energy of each pulse is 2 J to 5 J. It is preferable that the length of the pulse is 1.5 millisecond to 6 milliseconds. It is preferable that the pulse generating frequency is 2 pulse/second to 12 pulse/second. In this specification, energy of each pulse is a value obtained from a process in which a laser beam emitted from the laser beam source is received by an energy detection apparatus, such as a calorimeter or a power meter, before the laser welding operation is performed. Thus, energy per unit time (for example, one second) is measured, and then the energy is divided by the number of pulses per second.

When the foregoing method is employed, the perimeter laser weld portion having the maximum outer dimension dmax which is smaller than 2.0 mm is formed by using the heat resisting alloy composed of Fe groups or Ni groups as follows: A heretofore difficult laser weld portion can be formed. Specifically, a laser weld portion can be formed which has a structure that a ratio lmin/lmax of a minimum width lmin and a maximum width lmax of the perimeter laser weld portion in the superimposing direction of the noble metal chip is 0.7 or higher.

A spark plug according to the present invention comprises: a central electrode; a ground electrode disposed such that the side surface of the ground electrode is opposite to the leading end surface of the central electrode; and a noble-metal igniting portion having a discharge surface and provided for at least either of the central electrode or the ground electrode at a position corresponding to a spark discharge gap by welding a noble metal chip. In the spark plug, a chip securing surface forming portion of the central electrode and/or the ground electrode is constituted by a heat resisting alloy having Ni or Fe as a main component thereof. A perimeter laser weld portion is formed on the outer surface of the chip across the noble metal chip and the chip securing surface forming portion. A maximum outer dimension dmax of the perimeter laser weld portion plane-viewed from the chip interposing direction is smaller than 2.0 mm. The perimeter laser weld portion does not reach the discharge surface in the thickness direction of the noble metal chip. A ratio lmin/lmax of the perimeter laser weld portion in the superimposed direction to the chip securing surface is 0.7 or higher.

The fact that lmin/lmax can be made to be 0.7 or higher means a fact that circumferential dispersion of the distance from the discharging surface of the noble-metal igniting portion to the end of the perimeter laser weld portion adjacent to the discharging surface can satisfactorily be prevented. As a result, a problem can effectively be prevented which arises in that the discharging surface of the weld portion is exposed to the outside at a position at which the width of the laser weld portion is enlarged and the durability of the spark plug deteriorates. The manufacturing method according to the present invention is able to make the ratio lmin/lmax to be 0.9 or higher which is furthermore preferred value by appropriately determining the welding conditions.

PREFERRED EMBODIMENT OF THE INVENTION

An embodiment of the present invention will now be described.

Figure 1:
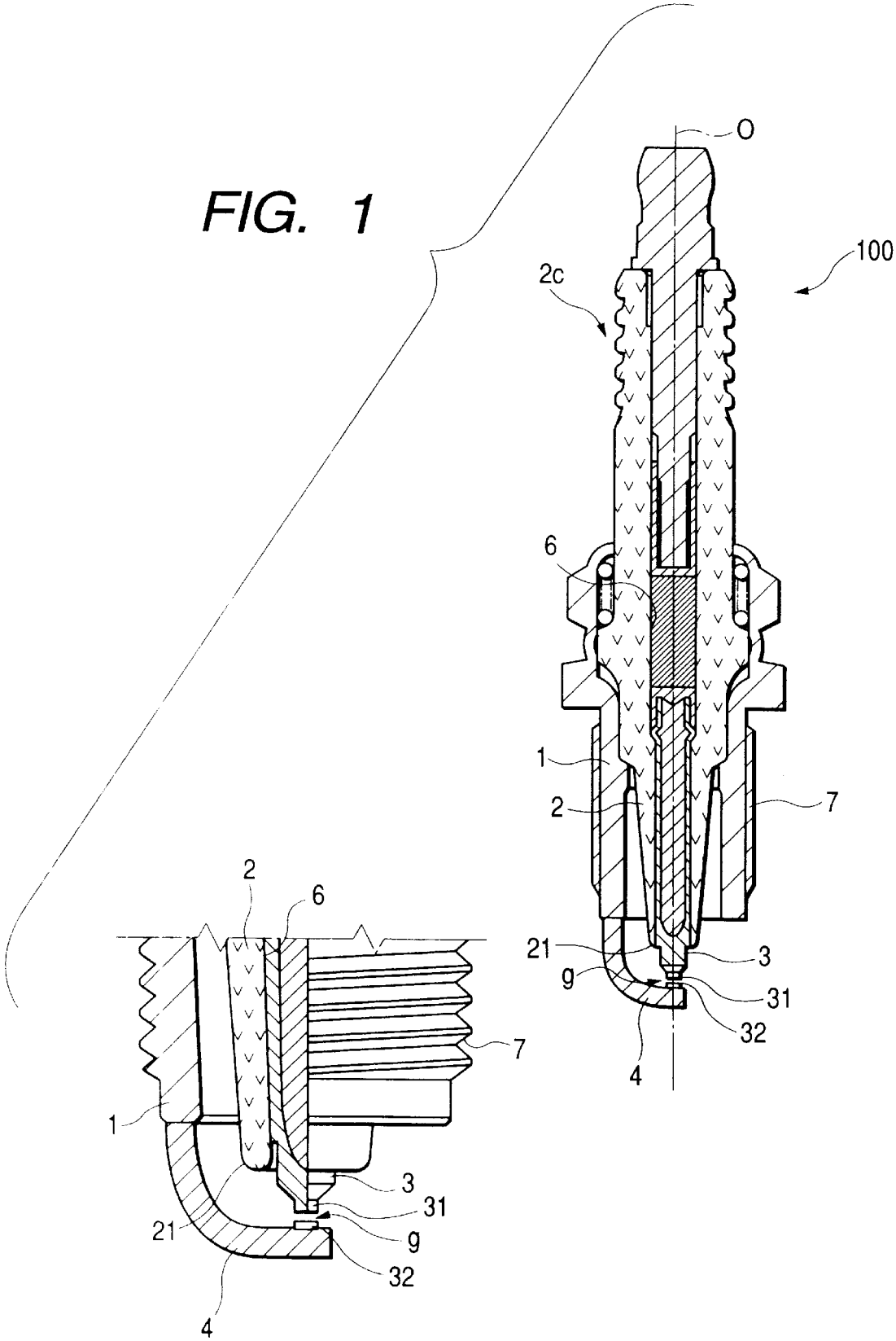
FIG. 1 is a vertical cross sectional view showing an embodiment of a spark plug according to the present invention and an enlarged view showing an essential portion of the same.

A spark plug 100 according to the embodiment of the present invention and shown in FIG. 1 incorporates a cylindrical main metal shell 1 and an insulating member 2 fitted to the inside portion of the main metal shell 1 such that a leading end 21 of the insulating member 2 projects. Moreover, the spark plug 100 incorporates a central electrode 3 disposed on the inside of the insulating member 2 in a state in which a noble-metal igniting portion (hereinafter simply called an "igniting portion") 31 projects. Moreover, the spark plug 100 incorporates a ground electrode 4 having an end joined to the main metal shell 1 by welding or the like and another end bent sidewards and disposed such that the side surface of the ground electrode 4 is positioned opposite to the leading end of the central electrode 3. The ground electrode 4 is provided with a noble-metal igniting portion (hereinafter simply called an "igniting portion") 32 disposed opposite to the igniting portion 31. A gap between the opposite igniting portion 31 and igniting portion 32 is a spark discharge gap g.

In this specification, the "igniting portion" is a portion of the joined noble metal chip on which an influence of change in the composition occurring due to the welding operation is not exerted (for example, a residual portion except for a portion alloyed with the material of the ground electrode and the material of the central electrode owing to the welding operation).

The insulating member 2 is made of a sintered body of ceramic, such as alumina or aluminum nitride. The insulating member 2 has a hole portion 6 formed in the axial direction of the insulating member 2 to receive the central electrode 3. The main metal shell 1 is formed into a cylindrical shape and made of a metal material, such as low-carbon steel, to constitutes a housing of the spark plug 100. Moreover, a screw portion 7 for joining the spark plug 100 to an engine block (not shown) is formed on the outer surface of the main metal shell 1.

A structure may be employed in which either of the igniting portion 31 or the opposite igniting portion 32 is omitted. In the foregoing case, spark discharge gap g is formed between the igniting portion 31 and the side surface of the ground electrode 4 for which the igniting portion is not provided. As an alternative to this, the spark discharge gap g is formed between the opposite igniting portion 32 and the front surface of the central electrode 3 for which the igniting portion is not provided.

Each of the central electrode 3 and the ground electrode 4 has the chip securing surface forming portion which has a structure that at least the surface layer is made of a heat resisting alloy, the main component of which is Ni or Fe (the "main component" means a component contained at a highest content, that is, "a component contained at 50 wt % or higher" is not meant). The heat resisting alloy, the main component of which is Ni or Fe, may be any one of the following materials.

(1) Heat Resisting Alloy Containing Ni Group: which is, in this specification, a generic name of heat resisting alloys of a type containing Ni by 40 wt % to 85% and a balance mainly consisting of one or more types of the following materials: Cr, Co, Mo, W, Nb, Al, Ti and Fe. Specifically, the following materials may be employed (their trade names are shown. Note that the composition of each of the following alloys is disclosed in a document (Metal Data Handbook Edition No. 3 (Maruzen), pp. 138) is omitted from description.

ASTROLOY, CABOT 214, D-979, HASTELLOY C22', HASTELLOY C276, HASTELLOY G30, HASTELLOY S, HASTELLOY X, HAYNESS 230, INCONEL 587, INCONEL 597, INCONEL 600, INCONEL 601, INCONEL 617, INCONEL 625, INCONEL 706, INCONEL 718, INCONEL X750, KSN, M-252, NIMONIC 75, NIMONIC 80A, NIMONIC 90, NIMONIC 105, NIMONIC 115, NIMONIC 263, NIMONIC 942, NIMONIC PE11, NIMONIC PE16, NIMONIC PK33, PYROMET 860, RENE 41, RENE 95, SSS 113MA, UDIMENT 400, UDIMENT 500, UDIMENT 520, UDIMENT 630, UDIMENT 700, UDIMENT 710, UDIMENT 720, UNITEP AF2-1 DA6 and WASPALOY.

(2) Heat Resisting Alloy Containing Fe Group: which is, in this specification, a generic name of heat resisting alloys of a type containing Fe by 20 wt % to 60 wt % and a balance mainly consisting of one or more types of the following materials: Cr, Co, Mo, W, Nb, Al, Ti and Ni. Specifically, the following materials may be employed (their trade names are shown. Note that the composition of each of the following alloys is disclosed in a document (Metal Data Handbook Edition No. 3 (Maruzen), pp. 138) is omitted from description.

A-286, ALLOY 901, DISCALOY, HAYNES 556, INCOLOY 800, INCOLOY 801, INCOLOY 802, INCOLOY 807, INCOLOY 825, INCOLOY 903, INCOLOY 907, INCOLOY 909, N-155, PYROMET CTX-1, PYROMET CTX-3, S-590, V-57, PYROMETCTX-1, 16-25-6, 17-14CuMo, 19-9DL and 20-Cb3.

On the other hand, each of the igniting portion 31 and the opposite igniting portion 32 is mainly constituted by noble metal, the main component of which is Ir or Pt. When the foregoing noble metal is employed, the consumption resistance of the igniting portion can be improved even in an environmental in which the temperature of the central electrode is easily raised. Moreover, weldability with respect to the foregoing heat resisting alloy can be improved. When noble metal, the base material of which is Pt, is employed, Pt may be employed solely. As an alternative to this, a Pt-Ni alloy (for example, a Ni alloy containing Pt by, for example, 1 wt % to 30 wt %), a Pt-Ir alloy or a Pt-Ir-Ni alloy may be employed. The alloy, the main component of which is Ir, may be an Ir-Pt alloy or an Ir-Rh alloy.

When the Ir-type noble metal is employed, oxide (including composite oxide) of a metal element belonging to group 3A (so-called "rare earth metal") of the periodic table or group 4A (Ti, Zr or Hf) may be contained in a range from 0.1 wt % to 15 wt %. Thus, oxidation and volatilization of the Ir component can effectively be prevented. Hence it follows that resistance of the igniting portion can be improved. It is preferable that $Y_2O_3$ is employed as the oxide. As an alternative to this, $La_2O_3$, $ThO_2$ or $ZrO_2$ may be employed. In the foregoing case, the metal component may be Ir in the form of a sole body as well as the Ir alloy.

The central electrode 3 has a tapered surface 3*t* having a truncated cone shape and formed at the leading end of the central electrode 3 so that the diameter of the central electrode 3 is reduced. Moreover, a disc-shape noble metal chip 31' (see FIGS. 5A to 5*d*) constituting the igniting portion 31 and having the composition of an alloy is superimposed on a front surface 3*s* of the central electrode 3. In addition, a perimeter laser weld portion 10 (hereinafter simply called a "weld portion") is, by laser welding, formed along the ends of the joined surface so as to be secured. Thus, the igniting portion 31 is formed. The opposite igniting portion 32 is formed by performing registration of the position of the noble metal chip 32' (see FIGS. 12A and 12B) and that of the ground electrode 4 at the position corresponding to the igniting portion 31. Similarly, a weld portion 20 is formed along the ends of the joined surfaces so as to be secured. The foregoing chips can be obtained by forming a molten alloy prepared by mixing and dissolving alloy components such that a predetermined composition is realized into a plate-like shape by hot rolling. Then, the plate-like member is punched so as to be formed into a predetermined chip shape by a hot punching process. As an alternative to this, a method may be employed with which an alloy is formed into a linear or a rod material by hot rolling or hot forging so as to be cut in the lengthwise direction to have a predetermined length. As an alternative to this, a spherical member may be employed which has been molded by an atomizing method. Each of the chips 31' and 32, has a diameter dc of 0.4 mm to 1.2 mm and a thickness tc of 0.5 mm to 1.5 mm.

Figure 2A:
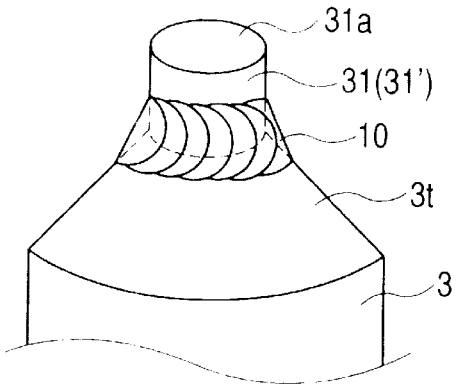
FIG. 2A is an enlarged perspective view of a leading end of a central electrode of the spark plug shown in FIG. 1
Figure 2B:
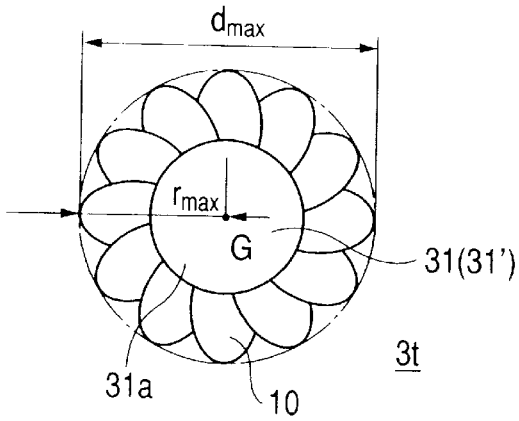
FIG. 2B is a plan view showing the front surface of the central electrode.
Figure 5A:
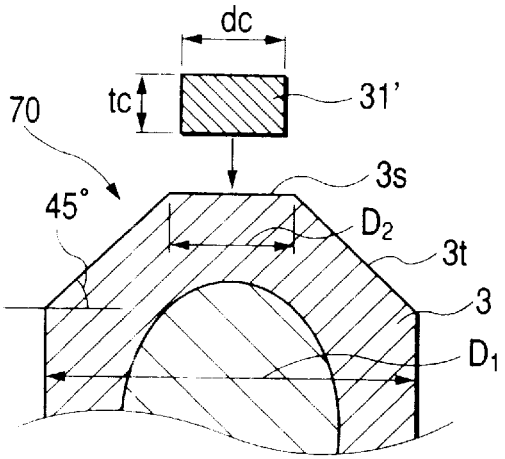
FIGS. 5A to 5D are diagrams showing a process for manufacturing an igniting portion of the central electrode of the spark plug shown in FIG. 1.

Since the igniting portions 31 and 32 are formed by substantially the same welding methods, a method of forming the igniting portion 31 adjacent to the central electrode 3 will now be described. As shown in FIG. 5A, a front surface 3*s* of the central electrode 3 is used as a chip securing surface (the surface to which the chip is secured). Then, the noble metal chip 31' is superimposed on the front surface 3*s* so that a superimposed assembly 70 is constituted. Then, the perimeter laser weld portion 10 is formed along the outer surface of the noble metal chip 31' of the superimposed assembly 70 at a position across the noble metal chip 31' and the chip securing surface. As a source of the laser beam, a pulse laser beam source (for example, a YAG laser beam source) 50 is employed which is arranged such that energy per pulse is 1.5 J to 6 J, the length of the pulse is 1 millisecond to 10 milliseconds and the pulse generating frequency is 2 pulse/second to 20 pulse/second. The perimeter laser weld portion 10 constituted by using the chip 31' having the above-mentioned size under the foregoing conditions has a maximum outer dimension dmax which is smaller than 2.0 mm, plane-viewed from the chip interposing direction as shown in FIG. 2B. Moreover, the perimeter laser weld portion 10 does not reach a discharging surface 31*a* in a direction of the thickness of the noble metal chip 31'. It is preferable that the maximum outer dimension dmax is 0.4 mm or larger. When the dmax is smaller than 0.4 mm, a uniform weld portion cannot easily be formed if the diameter of the laser beam is considerably reduced. Therefore, normal formation of the igniting portion is sometimes inhibited.

Each of the heat resisting alloy for use as the material of the electrode having a low heat conductivity at 800° C. which is 30 W·mK or lower has a characteristic that heat is easily accumulated in the alloy during the laser welding operation. The laser beam is employed which is arranged such that energy per pulse is 1.5 J to 6 J and the length of the pulse is 1 millisecond to 10 milliseconds. Thus, satisfactory uniformity of the perimeter laser weld portion 10 can be realized if the pulse generating frequency of 2 pulse/second to 20 pulse/second is employed. Specifically, a ratio lmin/lmax of minimum width lmin and maximum width lmax of the perimeter laser weld portion 10 in a direction of central axis of the chip 31' or the central electrode 3 can be made to be 0.7 or higher (preferably 0.9 or higher).

Figure 4A:
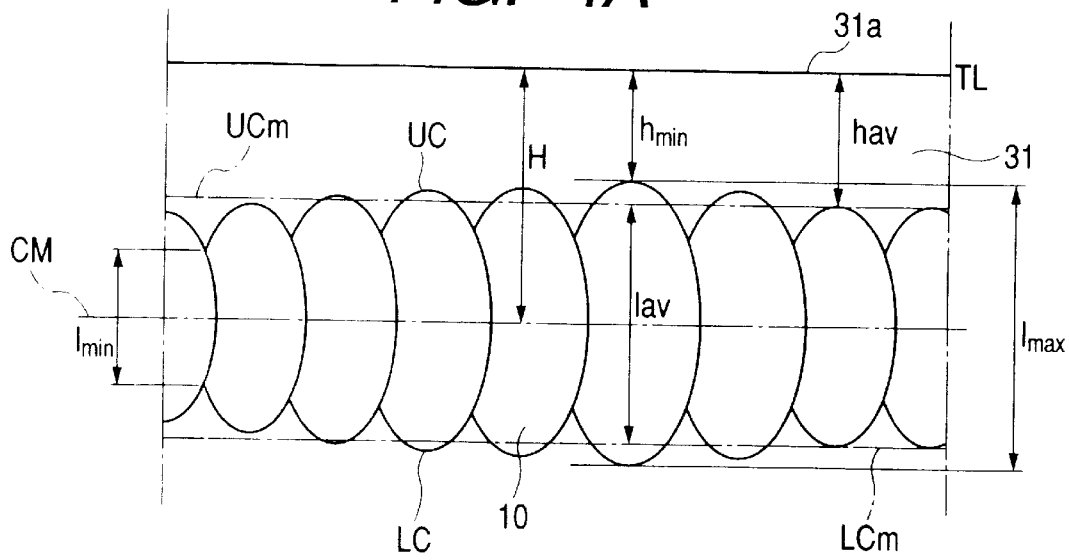
FIGS. 4A to 4D are developed views of a perimeter laser weld portion.

FIG. 4A is a developed view of a projected image formed when the perimeter laser weld portion 10 has been projected onto a cylindrical surface (having a diameter which is the same as the outer diameter of the discharging surface 31*a*) which is coaxial to the central axis O. In FIG. 4A, lmin and lmax are shown. Shortest distance hmin from outer end TL of the discharging surface 31*a* to an end of the perimeter laser weld portion 10 adjacent to the discharging surface 31*a* will now be described. Assuming that the distance from each end of the perimeter laser weld portion 10 adjacent to the discharging surface 31*a* to integral central line Ucm is average thickness hav of the igniting portions, it is preferable that hmin/hav is 0.7 or higher similarly to lmin/lmax. Thus, a problem can effectively be prevented which arises in that the weld portion is exposed to the discharging surface at the position at which hmin is realized (in many cases, a position at which the perimeter laser weld portion 10 has largest width (lmax)) owing to slight consumption of the noble-metal igniting portion and, therefore, misfire or the like occurs.

Figure 3A:
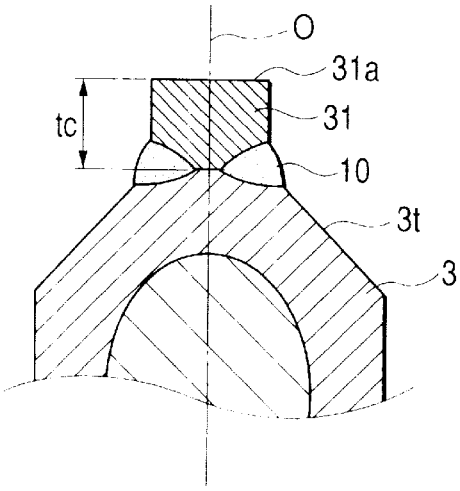
FIG. 3A is a vertical cross sectional view of FIG. 2A
Figure 3B:
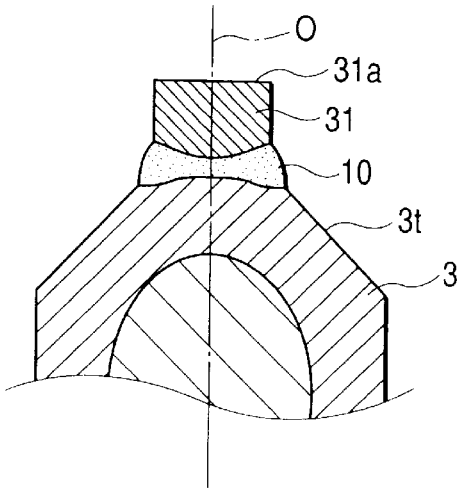
FIG. 3B is a vertical cross sectional view of its modification.

When the two side portions of the perimeter laser weld portion 10 across the central axis O of the perimeter laser weld portion 10 are not connected to each other in the radial direction as shown in FIG. 3A (in the foregoing case, the perimeter laser weld portion 10 is formed into an annular shape), thickness tc of the chip can be measured from the axial cross section after the welding operation has been completed. When the two sides portions of the weld portion 10 are connected to each other in the radial direction as shown in FIG. 3B (in the foregoing case, the perimeter laser weld portion 10 is formed into a disc shape), reference line CM is set at an intermediate position between integral central lines UCm and LCm on the two side ends of the perimeter laser weld portion 10 in the widthwise direction, as shown in FIG. 4A. Moreover, an assumption is made that distance H from the reference line CM to the outer end TL of the discharging surface 31*a* is tc to estimate the thickness.

Figure 4B:
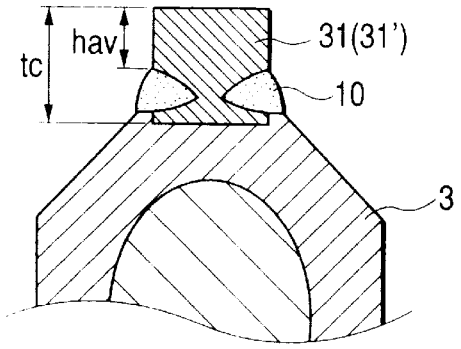

The diameter dc of the chip is arbitrarily determined to satisfy a range from 0.4 mm to 1.2 mm to correspond to the durability and the igniting performance required of the spark plug. In general, the noble metal chip is a costly chip. Therefore, the quantity of use of the noble metal chip must be reduced by reducing the thickness tc of the noble metal chip to 0.5 mm to 1.5 mm. It is preferable that the average thickness hav of the igniting portion is 0.2 mm to 1.0 mm. The reason for this lies in that a structure that hav is smaller than 0.2 mm causes exposure of the weld portion to the discharging surface owing to slight consumption of the noble-metal igniting portion to occur. Thus, the durability of the spark plug sometimes deteriorates. If hav is larger than 1.0 mm, the spark plug, which is at the end of its life owing to enlargement of the gap, must be changed in a state in which a considerably large quantity of the noble metal chip remains. Therefore, when the thickness tc of the chip can be confirmed even after the welding operation has been completed, it is preferable that ratio hav/tc of the average thickness hav of the igniting portion and the thickness tc of the chip is about 0.13 to 2.0. When the end of the noble metal chip 31' opposite to the discharging surface projects adjacent to the base portion as compared with the weld portion 10 as shown in FIG. 4B, there arises a problem in that the overall projecting portion comes naught regardless of the end of the life even if hav/tc is 0.2 to 1.0.

Figure 4C:
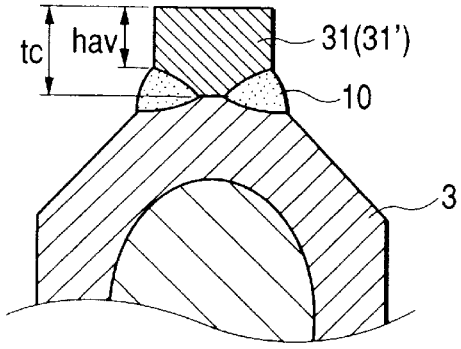
Figure 4D:
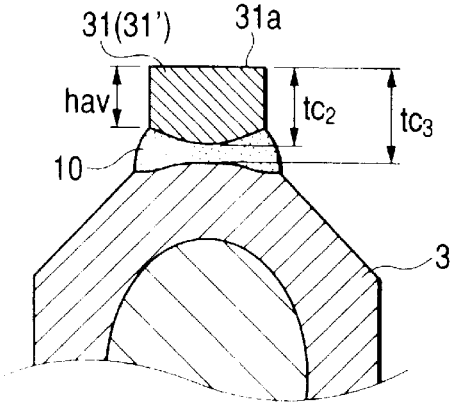

To prevent separation of the noble metal chip from the central electrode, it is preferable that lav is 0.4 mm or larger on an assumption that the distance between UCm and LCm is average width lav of the weld portion. When two sides portion of the weld portion across the central axis are not connected to each other in the radial direction as shown in FIG. 4C, it is preferable that tc—hav is 0.2 mm or larger. A case will now be described in which the two side portions of the weld portion in the radial direction are connected to each other as shown in FIG. 4D. An assumption is made that the distance from the discharging surface 31*a* to a position on the joint surface between the perimeter laser weld portion 10 and the igniting portion 31 at which the perimeter laser weld portion 10 has a smallest thickness in the axial direction of the central electrode 3 is tc2 and the distance to a position at which the perimeter laser weld portion 10 has a smallest thickness on the joint surface between the perimeter laser weld portion 10 and the central electrode 3 is tc3. It is preferable that tc3—tc2 is 0.2 mm or longer.

The preferred welding conditions according to the present invention will now be described.

Figure 5C:
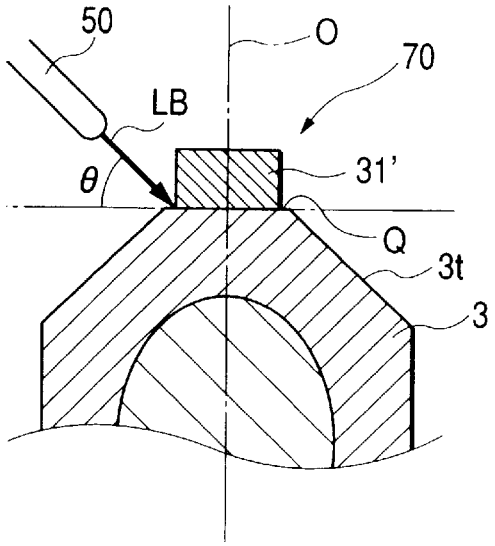
Figure 5B:
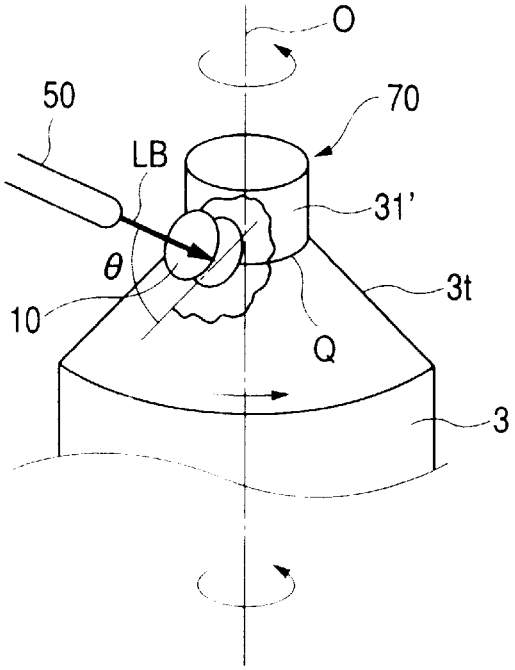

When the noble metal chip 31' is formed into the disc-like shape according to this embodiment, it is rational to employ a method with which the outer surface of the igniting portion 31 is irradiated with laser beam LB while the superimposed assembly 70 of the igniting portion 31 and the central electrode 3 are being rotated around the central axis O of the igniting portion 31 with respect to a laser beam source 50, as shown in FIG. 5B. Thus, the perimeter laser weld portion can uniformly be formed. In the foregoing case, only either of the superimposed assembly 70 or the laser beam source 50 may be rotated. As an alternative to this, both of the units may be rotated (for example, in opposite directions).

In the foregoing case, it is preferable that the rotational speed is adjusted as follows: the relative rotational speed between the superimposed assembly 70 and the laser beam source 50 is 10 rpm or higher (preferably 12 rpm or higher) when only one laser beam source 50 is used. To perform the perimeter laser welding operation, the superimposed assembly 70 and the laser beam source 50 must relatively be rotated by one or more times. If the relative rotational speed is lower than 10 rpm, time for which the welding operation is performed in one rotation, that is, dead time for manufacturing one spark plug, is elongated excessively. Therefore, an advantage cannot always be realized as compared with the conventional method.

Figure 6A:
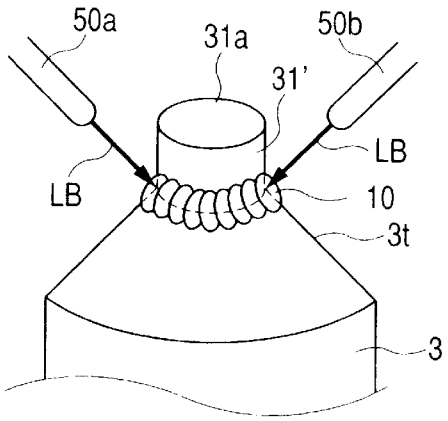
FIGS. 6A and 6B are diagrams showing a modification of the manufacturing process shown in FIGS. 5A to 5D.
Figure 6B:
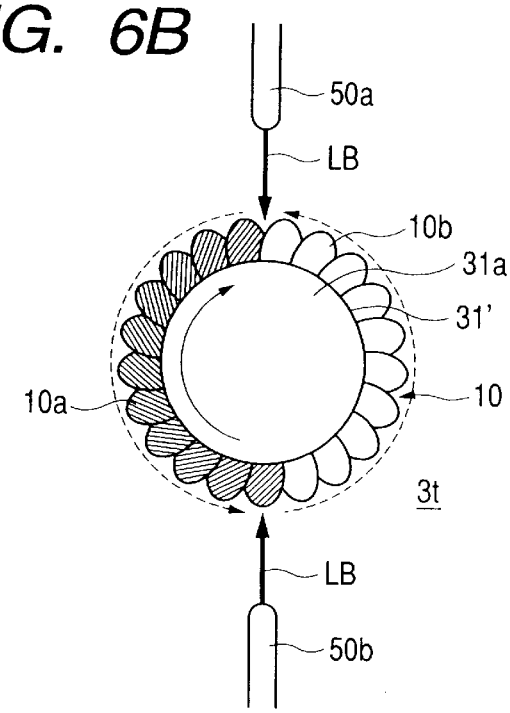
Figure 7:
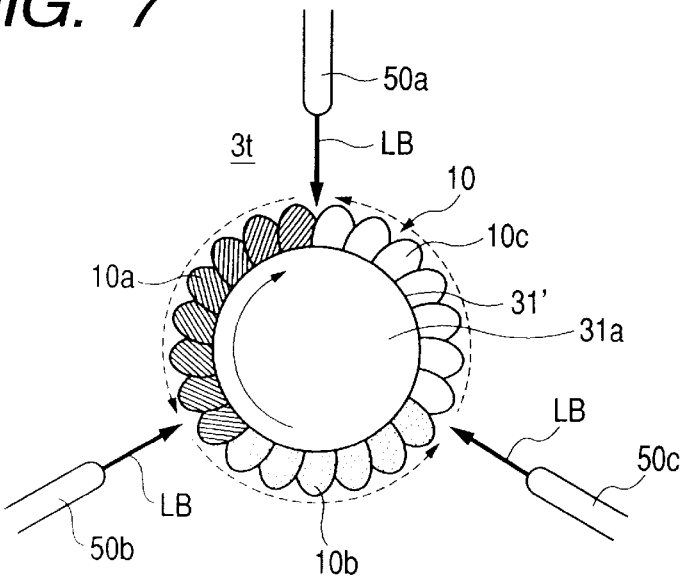
FIG. 7 is a diagram showing another modification of the same.

When a plurality of laser beam sources are disposed in the circumferential direction of the chip 31' at predetermined intervals as shown in FIG. 6B or FIG. 7 to perform the welding operation, the number of revolutions required until the welding operation is completed can sometimes be reduced. Thus, the lower limit of the relative rotational speed can sometimes be reduced. When two laser beam source 50*a* and 50*b* disposed apart from each other by an angular degree of about 180° are used to perform the welding operation as shown in FIGS. 6A and 6B, the laser beam sources 50*a* and 50*b* are operated for corresponding weld portions 10*a* and 10*b* each of which corresponds to the halfway of the round. When three laser beam sources 50*a* to 50*c* disposed apart from one another at intervals of about 120° as shown in FIG. 7 are used to perform the welding operation, the laser beam sources 50*a* to 50*c* are required to be operated for weld portions 10*a* to 10*c* each of which corresponds to about ⅓ round.

Also in a case where a plurality of laser beam sources are employed, each laser beam source must satisfy the laser welding conditions according to the present invention. The reason for this will now be described. When a plurality of laser beam sources (n which satisfies the relationship that $n \geqq 2$) are used, rise in the temperature of the chip 31' occurring when laser beams are applied simultaneously takes place considerably. As described above, each laser beam source is required to irradiate the weld portion corresponding to substantially (1/n) round of the chip 31'. Therefore, the welding operation can be completed in a time which is (1/n) of time required when a sole laser beam source is employed. As a result, time required to input heat to the chip 31' can be shortened and, therefore, a problem that the width of each weld portion is enlarged excessively can be prevented. When the plural laser beam sources are employed to simultaneously apply laser beams, time required to complete the weld portion can be shortened. Thus, productivity can be improved.

The upper limit of the relative rotational speed will now be described. When the superimposed assembly 70 is rotated, it is preferable that the highest rotational speed is not higher than about 240 rpm (four rotations per second) in order to prevent deformation and scatter of molten metal owing to centrifugal force and produced during the welding operation. On the other hand, centrifugal force which is exerted on the perimeter laser weld portion 10 is considered to be enlarged substantially in proportion to the maximum outer dimension dmax and enlarged substantially in proportion to the square of the rotational angular velocity. When the foregoing facts are considered, it is preferable that the rotational speed of the superimposed assembly 70 is set to be a value which is defined by the following equation (note that the unit of dmax below is mm):

$$V\max = 5\pi(2/d\max)^{1/2} \text{(unit: radian/second)} \quad (1)$$

As can be understood from equation (1), Vmax can be enlarged as dmax is reduced. When dmax=2.0 mm, Vmax is about 150 rpm. When dmax=1.5 mm, Vmax is 173 rpm. When dmax=0.7 mm, Vmax=253 rpm. When both of the superimposed assembly 70 and the laser beam source 50 are rotated to realize a predetermined relative rotational speed, raising of the rotational speed of the portion adjacent to the central electrode enables the rotational speed of the mechanism of the laser beam source 50 which must have a relatively complex structure to be reduced (or no rotation is required). Thus, simplification of the mechanism of the laser beam source 50 or reduction in the load of the rotation which must be born is permitted.

Figure 8A:
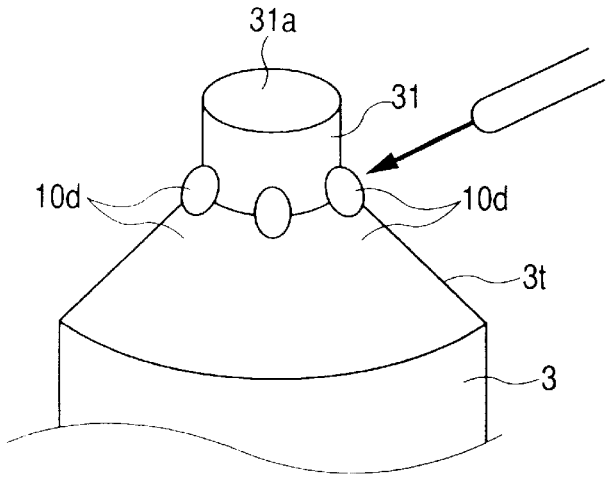
FIGS. 8A and 8B are diagrams showing another modification of the same.
Figure 8B:
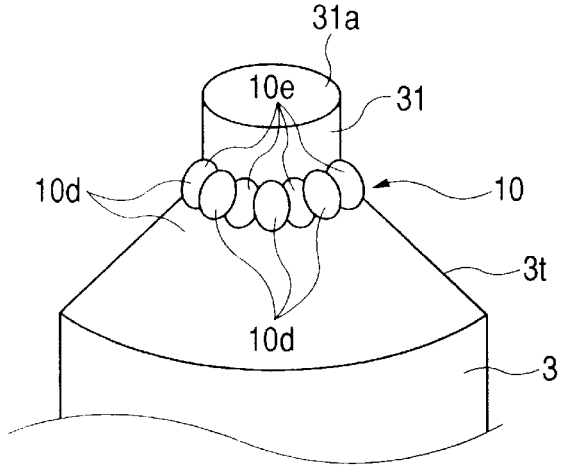

When the relationship that dmax<0.78 mm is substantially held, Vmax is higher than 240 rpm which is the preferred upper limit in accordance with equation (1). As a result of investigations performed by the inventor of the present invention, at least five pulse-welded beads must be formed in one round to form the weld portion 10 which is completely continued in the circumferential direction by using the laser beam having energy of 1.5 J to 6 J per pulse even in a case of the foregoing chip having the small diameter. The foregoing velocity of 240 rpm corresponds to four rotations per second which permits only five pulses per second or smaller if 20 pulse/second, which is the upper limit of the pulse generating frequency, is set. Therefore, if the rotational speed is higher than the above-mentioned speed, weld beads 10*d* are intermittently formed in the circumferential direction, as shown in FIG. 8A . Therefore, there is apprehension that pulse weld beads continued in the circumferential direction cannot be formed during one rotation. Therefore, it is advantageous that the rotational speed of about 240 rpm is maintained from a viewpoint of equation (1) if rotational speed higher than 240 rpm is permitted. When execution of second and following welding operations is permitted, shift of the angular phase at which the weld beads 10*d* are formed enables the weld portion 10 continued in the circumferential direction to be formed, as shown in FIG. 8B.

When the laser beam source 50 is rotated, it is preferable that the rotational speed of the laser beam source 50 is 90 rpm or lower in order to prevent undesirable shift of the position irradiated with the emitted laser beam.

To form the weld portion 10 which does not reach the discharging surface 31*a* when the thickness tc of the noble metal chip 31, is small as described above, it is effective to apply the pulse laser beam LB from a diagonally upper position. Specifically, as shown in FIGS. 5B and 5C, it is preferable that the superimposed assembly 70 is irradiated with the pulse laser beam LB as follows. That is, an end Q of intersection between the surface to which the chip is secured (which is the front surface of the central electrode 3) and the outer surface of the chip is included in a spot of the laser beam LB and irradiation angle θ with respect to the surface to which the chip is secured satisfies a range from 0° to 60° (for example, 45°).

Figure 5D:
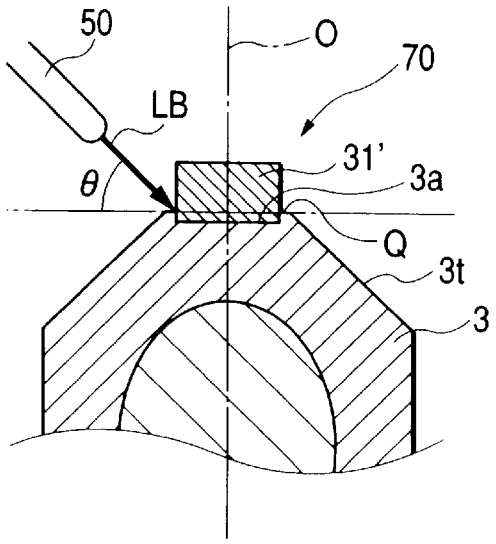

To facilitate location and securing of the noble metal chip 31' with respect to the surface to which the chip is secured, a process maybe employed in which the locating recess 3*a* corresponding to the outer shape of the chip is formed in the surface to which the chip is secured, as shown in FIG. 5D. Then, the noble metal chip 31' is fitted in the locating recess 3*a* to constitute the superimposed assembly 70. To reliably perform the welding and joining operation in the foregoing case, it is preferable that the end Q of the intersection between the end of the opening portion of the recess 3*a* and the outer surface of the chip is irradiated with the pulse laser beam LB.

Figure 9:
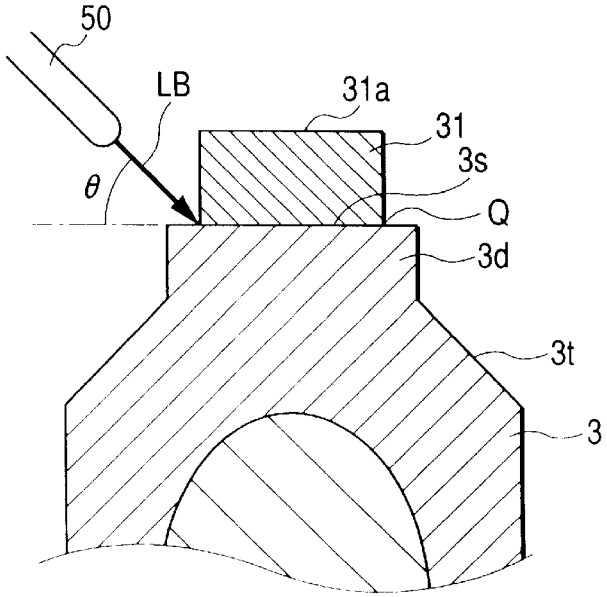
FIG. 9 is a diagram showing a process for manufacturing a spark plug according to the modification.
Figure 10A:
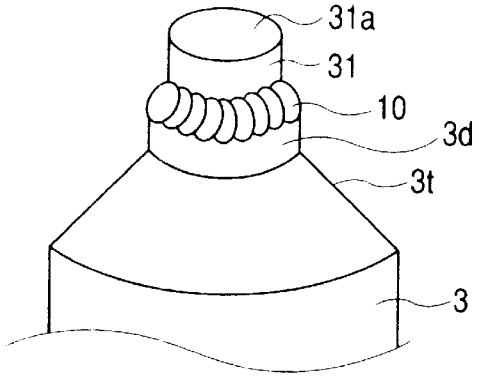
FIG. 10A is a perspective view showing an essential portion of the spark plug manufactured by the manufacturing process shown in FIG. 9, FIGS. 10B and 10C are vertical cross sectional view showing the spark plug, and FIGS. 10A' to 10C' are vertical cross sectional view showing a modification of the spark plug as shown in FIGS. 10A to 10C, respectively.
Figure 10A:
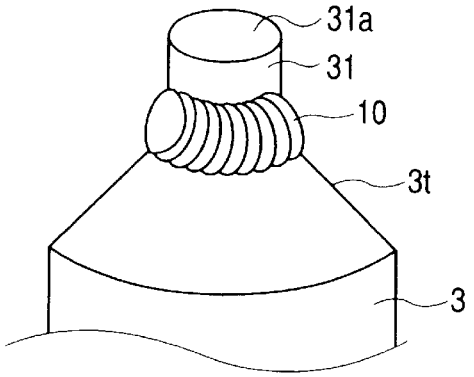
Figure 10B:
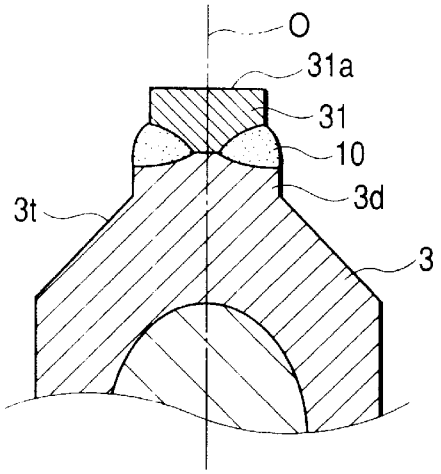
Figure 10B:
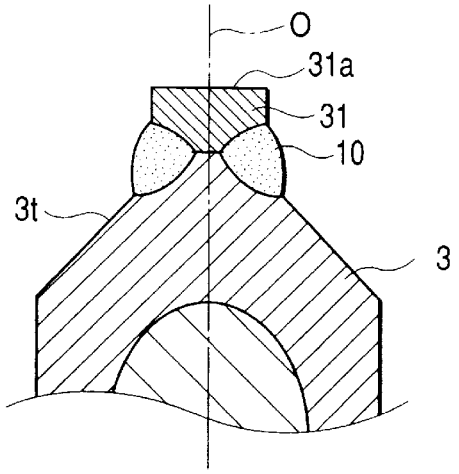
Figure 10C:
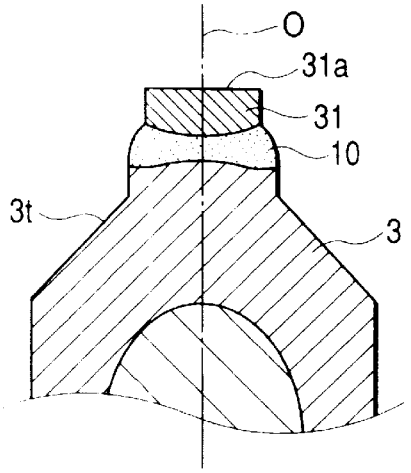
Figure 10C:
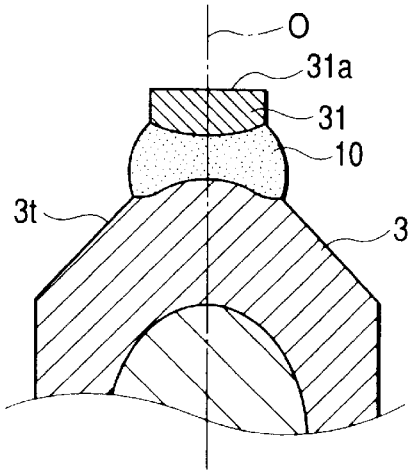

Another method arranged as shown in FIG. 9 may be employed. That is, a cylindrical projection 3*d* is formed at the leading end of the tapered surface 3*t* of the central electrode 3. Moreover, the flat front surface 3*s* is used as the surface to which the chip is secured. The noble metal chip 31' is superimposed on the front surface 3*s*. Then, the pulse laser beam LB is applied to the end Q of the intersection between the surface to which the chip is secured and the outer surface of the chip. FIG. 10A is an enlarged perspective view showing a portion in the vicinity of the igniting portion 31 of a spark plug manufactured as described above. FIGS. 10B and 10C are vertical cross sectional views of the foregoing portion. FIG. 10B shows a state in which the two side portions across the central axis O of the weld portion 10 are not connected to each other. FIG. 10C shows a state in which the two side portions are connected to each other in the radial direction. As shown in FIGS. 10A', 10B' and 10C', a shape may be employed in which the overall body of the projection 3*d* is melted so as to be included in the weld portion 10.

Figure 11:
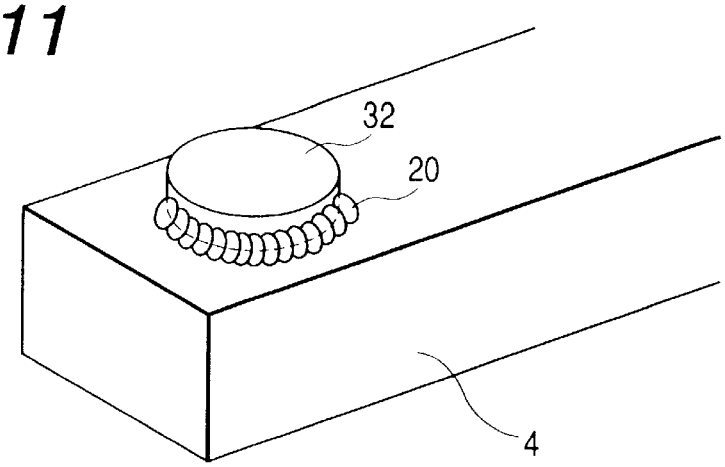
FIG. 11 is a perspective view showing an igniting portion of the ground electrode.
Figure 12A:
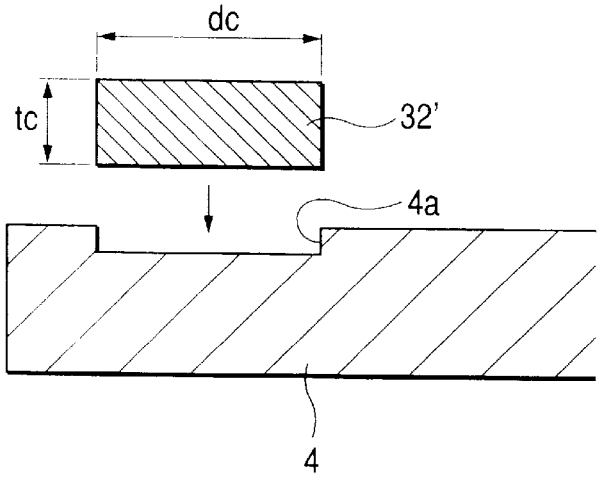
FIGS. 12A and 12B are diagrams showing a process for manufacturing the spark plug of FIG. 11.
Figure 12B:
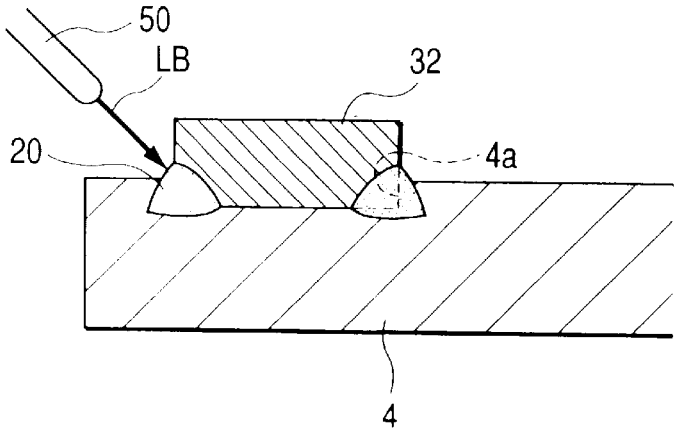
Figure 13A:
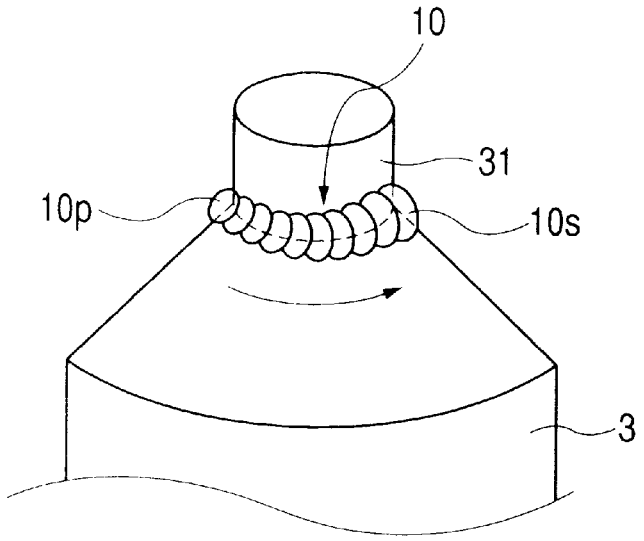
FIGS. 13A and 13B are diagrams showing problems experienced with the conventional manufacturing method.
Figure 13B:
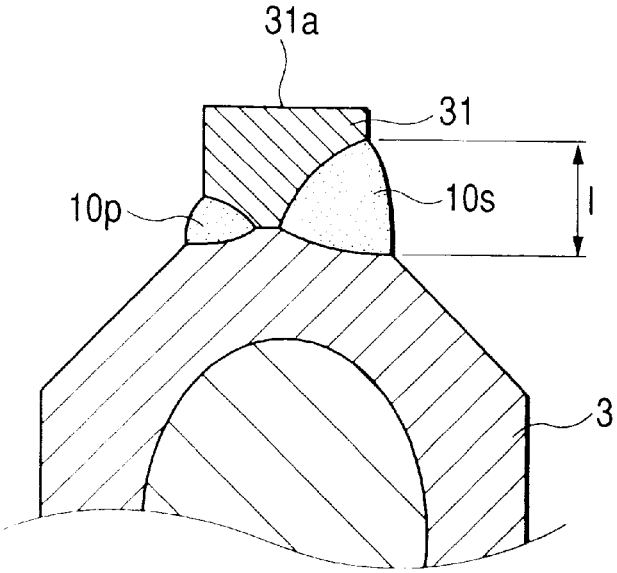

FIG. 11 shows a state in which the igniting portion 32 of the ground electrode 4 is formed. A perimeter laser weld portion 20 similar to that of the central electrode 3 is formed. As shown in FIG. 12A, the side surface which will face the spark discharge gap g of the ground electrode 4 (see FIG. 1) is used as the surface to which the chip is secured. A recess 4*a* is formed in the foregoing surface. Then, the noble metal chip 32' is fitted and secured into the recess 4*a*. In the foregoing state, the laser beam source 50 is operated similarly to the method shown in FIG. 5B or the like so that the weld portion 20 is formed.

Table 1 shows preferred laser welding conditions (energy per pulse, the length of the pulse, the pulse generating frequency and the relative number of revolutions between the laser beam source and the superimposed assembly (note that the number of the laser beam source is one) when the weld portions having a variety of dmax are formed by using noble metal chips made of a variety of materials.

TABLE 1

| dmax (mm) | Composition of Noble Metal Chip (wt %) | Energy of Laser Beam (J/pulse) | Length of Pulse (μs) | Pulse Generating Frequency (pulse/second) | Relative Number of Revolutions (rpm) |
|---|---|---|---|---|---|
| 1.1 | 90Pt-10Ir, 80Pt-20Ir | 2 | 2 | 12 | 60 |
| 0.5 | 100Ir, 95Ir-5Rh, 95Ir-5Pt 90Ir-10Rh, 80Ir-20Rh | 2 | 2 | 9 | 60 |
| 1.9 | 95Ir-5Pt, 80Ir-20Rh 90Ir-10Rh, 98Ir-2$Y_2O_3$ | 3 | 6 | 3 | 10 |

Examples

To confirm the effects of the present invention, the following experiments were performed. First, INCONEL 600 was employed to manufacture the central electrode 3 formed as shown in FIG. 1. Note that outer diameter D1 of the base portion shown in FIG. 5A was 2.5 mm, diameter D2 of the front surface was 1.3 mm and the tapered angle of the tapered surface 3*t* was 45°. On the other hand, noble metal chips having a variety of diameters such that the thickness was 0.6 mm to 0.8 mm and the outer diameter was 0.4 mm to 1.5 mm were manufactured by punching a 80Pt-20Ir (wt %) alloy plate manufactured by melting an alloy/rolling.

Then, a stationary YAG laser beam source arranged to have a beam diameter of 0.4 mm at the focal point was prepared as the laser beam source. The conditions were set such that energy of the output laser beam was 1.8 J/pulse to 3 J/pulse, the width of the pulse was 2 milliseconds to 6 millisecond and the pulse generating frequency was 1 pulse/second to 23 pulse/second. Each noble metal chip was superimposed on the surface of the front surface of the central electrode 3 arranged to be the surface to which the chip was secured. The method shown in FIGS. 5A to 5D (q=45°) was employed so that the laser beam source was operated to form the weld portion 10 while the central electrode 3 was being rotated by one rotation at a rotational speed of 60 rpm. After the welding operation was completed, a magnifier was used to measure the maximum width lmax and the minimum width lmin of the formed weld portion 10. Samples satisfied the relationship that lmin/max≧0.9 were evaluated as excellent (○), samples satisfied the relationship that 0.9>lmin/lmax≧0.7 were evaluated as satisfactory (Δ). Samples satisfied the relationship that 0.7>lmin/lmax were evaluated as defective (x). Results are shown in Table 2.

As described above and seen from Table 2, the samples welded under the conditions within the scope of the present invention were evaluated as excellent or satisfactory.

TABLE 2

| Condition of Pulse | Diameter of Chip (mm) | Thickness of Chip (mm) | Dmax | PPS 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 |
|---|---|---|---|---|---|---|---|---|---|---|---|---|---|---|---|---|---|---|---|---|---|---|---|---|---|---|
| 6 μs | 1.5 | 0.8 | 2.0 | ○ | Δ | X | X | X | X | X | X | X | X | X | X | X | X | X | X | X | X | X | X | X | X | X |
| 3J/pulse | 1.5 | 0.8 | 1.8 | ○ | ○ | ○ | ○ | ○ | ○ | ○ | ○ | ○ | ○ | ○ | ○ | ○ | ○ | Δ | Δ | Δ | Δ | Δ | Δ | X | X | X |
| | 1.5 | 0.8 | 1.6 | ○ | ○ | ○ | ○ | ○ | ○ | ○ | ○ | ○ | ○ | ○ | ○ | ○ | ○ | Δ | Δ | Δ | Δ | Δ | Δ | X | X | X |
| 2 μs | 0.8 | 0.6 | 1.4 | ○ | ○ | ○ | ○ | ○ | ○ | ○ | ○ | ○ | ○ | ○ | ○ | ○ | ○ | ○ | ○ | Δ | Δ | Δ | Δ | Δ | X | X |
| 2J/pulse | 0.8 | 0.6 | 1.2 | ○ | ○ | ○ | ○ | ○ | ○ | ○ | ○ | ○ | ○ | ○ | ○ | ○ | ○ | ○ | ○ | ○ | Δ | Δ | Δ | Δ | X | X |
| | 0.8 | 0.6 | 1.0 | ○ | ○ | ○ | ○ | ○ | ○ | ○ | ○ | ○ | ○ | ○ | ○ | ○ | ○ | ○ | ○ | ○ | Δ | Δ | Δ | Δ | X | X |
| | 0.8 | 0.6 | 0.8 | ○ | ○ | ○ | ○ | ○ | ○ | ○ | ○ | ○ | ○ | ○ | ○ | ○ | ○ | ○ | ○ | ○ | Δ | Δ | Δ | Δ | X | X |
| | 0.8 | 0.6 | 0.6 | ○ | ○ | ○ | ○ | ○ | ○ | ○ | ○ | ○ | ○ | ○ | ○ | ○ | ○ | ○ | ○ | Δ | Δ | Δ | Δ | X | X | X |
| 2 μs 1.8J/pulse | 0.4 | 0.6 | 0.4 | ○ | ○ | ○ | ○ | ○ | ○ | ○ | ○ | ○ | ○ | ○ | ○ | ○ | ○ | ○ | Δ | Δ | Δ | Δ | Δ | X | X | X |

What is claimed is:

1. A method of manufacturing a spark plug comprising a central electrode and a ground electrode disposed such that the side surface of the ground electrode is opposite to the leading end surface of the central electrode and having a structure that a noble-metal igniting portion having a discharge surface is provided for at least either of the central electrode or the ground electrode at a position corresponding to a spark discharge gap by welding a noble metal chip, the method of manufacturing a spark plug comprising the steps of:

forming a chip securing surface forming portion of the central electrode and/or the ground electrode with a heat resisting alloy having Ni or Fe as a main component thereof and superimposing the noble metal chip on a chip securing surface of the chip securing surface forming portion so as to form a superimposed assembly;

providing a perimeter laser weld portion across the noble metal chip and the chip securing surface forming portion for the outer surface of the chip constituting the superimposed assembly so that the noble metal chip is secured to the chip securing surface; and forming the perimeter laser weld portion to have a maximum outer dimension dmax, when plan-viewed from a chip interposing direction, that is smaller than 2.0 mm, and so formed not to reach the discharge surface in a direction of the thickness of the noble metal chip by using, as a light source for laser welding, a pulse laser beam source having energy per pulse of 1.5 J to 6 J, a pulse length of 1 millisecond to 10 millisecond and a pulse generation frequency of 2 pulse/second to 20 pulse/second, wherein a single weld pass is employed in the forming step and a ratio lmin/lmax of a minimum width lmin and a maximum width lmax of the perimeter laser weld portion plan-viewed from the noble metal chip superimposing direction is 0.7 or higher.

2. A method of manufacturing a spark plug comprising a central electrode and a ground electrode disposed such that the side surface of the ground electrode is opposite to the leading end surface of the central electrode and having a structure that a noble-metal igniting portion having a discharge surface is provided for at least either of the central electrode or the ground electrode at a position corresponding to a spark discharge gap by welding a noble metal chip, the method of manufacturing a spark plug comprising the steps of:

forming a chip securing surface forming portion of the central electrode and/or the ground electrode with a heat resisting alloy having Ni or Fe as a main component thereof and superimposing the noble metal chip on a chip securing surface of the chip securing surface forming portion so as to form a superimposed assembly;

providing a perimeter laser weld portion across the noble metal chip and the chip securing surface forming portion for the outer surface of the chip constituting the superimposed assembly so that the noble metal chip is secured to the chip securing surface; and forming the perimeter laser weld portion to have a maximum outer dimension dmax, when plan-viewed from a chip interposing direction, that is smaller than 2.0 mm, and so formed not to reach the discharge surface in a direction of the thickness of the noble metal chip by using, as a light source for laser welding, a plurality of pulse laser beam sources having energy per pulse of 1.5 J to 6 J, a pulse length of 1 millisecond to 10 millisecond and a pulse generation frequency of 2 pulse/second to 20 pulse/second, wherein a ratio lmin/lmax of a minimum width lmin and a maximum width lmax of the perimeter laser weld portion plan-viewed from the noble metal chip superimposing direction is 0.7 or higher.

3. The method of manufacturing a spark plug according to claim 1, wherein the maximum outer dimension dmax of the perimeter laser weld portion is 0.4 mm or greater.

4. The method of manufacturing a spark plug according to claim 1, wherein the heat resisting alloy for constituting the chip securing surface forming portion is formed has a heat conductivity at 800° C. of 30 Wm·K or lower.

5. The method of manufacturing a spark plug according to claim 1, wherein the noble metal chip is formed into a disc shape, and the outer surface of the chip is irradiated with a pulse laser beam while the superimposed assembly of the noble metal chip and the central electrode or the ground electrode are being rotated around the central axis of the chip with respect to the laser beam source.

6. The method of manufacturing a spark plug according to claim 5, wherein when an assumption is made that maximum outer dimension of the perimeter laser weld portion is dmax (unit: mm), relative rotational speed between the superimposed assembly and the laser beam source is 10 rpm or more and rotational speed of the superimposed assembly is lower than $5\pi(2/\mathrm{dmax})^{1/2}$(unit: radian/second).

7. The method of manufacturing a spark plug according to claim 1, wherein the superimposed assembly is irradiated with the pulse laser beam in such a manner that an end of intersection between the surface to which the chip is secured and the outer surface of the chip is included in a laser beam spot, and an irradiation angle $\theta$ of the surface to which the chip is secured with the laser beam satisfies a range from 0° to 60°.

8. The method of manufacturing a spark plug according to claim 7, wherein a locating recess corresponding to the outer shape of the chip is formed in the chip securing surface and the noble metal chip is fit in the locating recess so that the superimposed assembly is constituted, and an end of intersection between an end of opened portion of the recess and the outer surface of the chip is irradiated with the pulse laser beam.

9. The method of manufacturing a spark plug according to claim 1, wherein the main component of the noble metal chip is Pt or Ir.

10. A spark plug according to the present invention comprises:

a central electrode;

a ground electrode disposed such that a side surface of the ground electrode is opposite to a leading end surface of the central electrode; and a noble-metal igniting portion having a discharge surface and provided for at least either of the central electrode or the ground electrode at a position corresponding to a spark discharge gap;

wherein a chip securing surface forming portion of the central electrode and/or the ground electrode is constituted by a heat resisting alloy having Ni or Fe as a main component thereof;

a perimeter laser weld portion is formed by a single weld pass on the outer surface of the chip across the noble metal chip and the chip securing surface fomiing portion;

a maximum outer dimension dmax of the perimeter laser weld portion, when plan-viewed from the chip interposing direction, is smaller than 2.0 mm, the perimeter laser weld portion does not reach the discharge surface in the thickness direction of the noble metal chip, and a ratio lmin/lmax of the perimeter laser weld portion in the superimposed direction to the chip securing surface is 0.7 or higher.

* * * * *